US005364051A

United States Patent [19]

Philpot

[11] Patent Number: 5,364,051

[45] Date of Patent: Nov. 15, 1994

[54] LOCATOR CLIP

[75] Inventor: James E. Philpot, Cookeville, Tenn.

[73] Assignee: Teledyne Industries Inc., Cookeville, Tenn.

[21] Appl. No.: 53,684

[22] Filed: Apr. 29, 1993

[51] Int. Cl.[5] ..... A47B 96/06

[52] U.S. Cl. ..... 248/229; 248/300; 248/74.2; 248/62; 248/316.7

[58] Field of Search ..... 248/229, 230, 231, 231.7, 248/231.8, 300, 316.1, 316.5, 316.7, 65, 66, 68.1, 74.1, 74.2, 74.3, 73, 56, 62, 52, 901

[56] References Cited

U.S. PATENT DOCUMENTS

| | | | |
|---|---|---|---|
| 682,847 | 9/1901 | Forsyth | 248/74.1 X |
| 2,382,678 | 8/1945 | Tinnerman | 248/74.3 |
| 2,408,572 | 10/1946 | Morehouse | 248/74.3 |
| 2,434,720 | 1/1948 | Robertson et al. | 248/74.3 |
| 2,523,785 | 9/1950 | Sereno | 248/316.7 X |
| 2,527,442 | 10/1050 | Odegaard | 268/71 |
| 2,863,202 | 12/1958 | Hanna | 248/316.7 X |
| 2,997,265 | 8/1961 | Weiss | 248/300 |
| 3,150,539 | 9/1964 | Wallis, Jr. | 268/74.1 X |
| 3,216,685 | 11/1965 | Raymond | 248/316.7 X |
| 3,681,991 | 8/1972 | Eberly, Jr. . | |
| 4,705,498 | 11/1987 | Goss . | |
| 4,776,891 | 10/1988 | Murtha . | |
| 4,824,057 | 4/1989 | Suprono | 248/62 |

*Primary Examiner*—Ramon O. Ramirez
*Assistant Examiner*—Korie H. Chan
*Attorney, Agent, or Firm*—Dennison, Meserole, Pollack & Scheiner

[57] ABSTRACT

A locator clip including a central sleeve engageable about a heating element sheath. The clip includes a pair of overlying end panels integral with the sleeve and centrally aperatured to accommodate a temperature probe transversely across the sleeve received sheath. The clip sleeve opens upwardly to expose the sheath to the overlying probe for intimate contact therebetween encouraged by a resilient retaining flap engaging the probe.

3 Claims, 1 Drawing Sheet

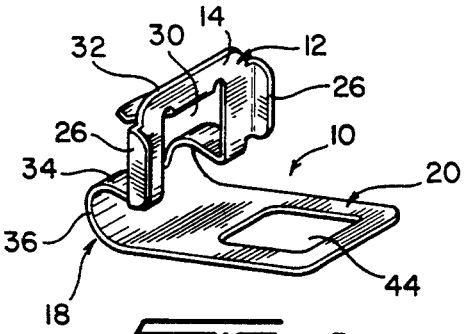
FIG. 1
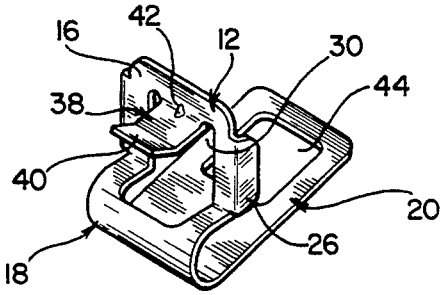
FIG. 2
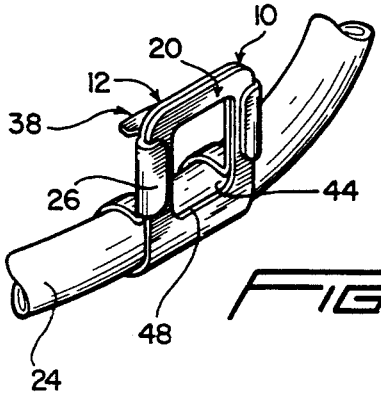
FIG. 3
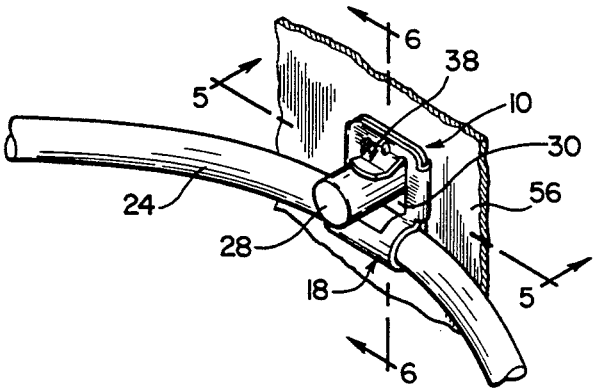
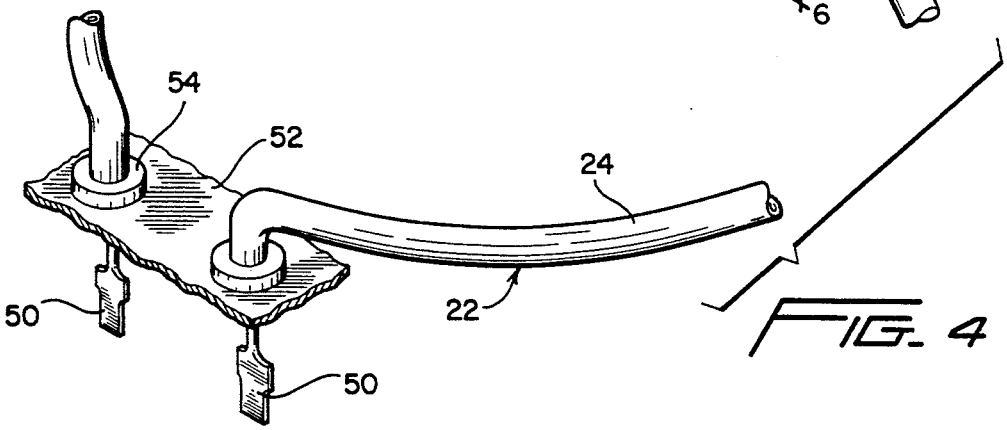
FIG. 4
FIG. 5
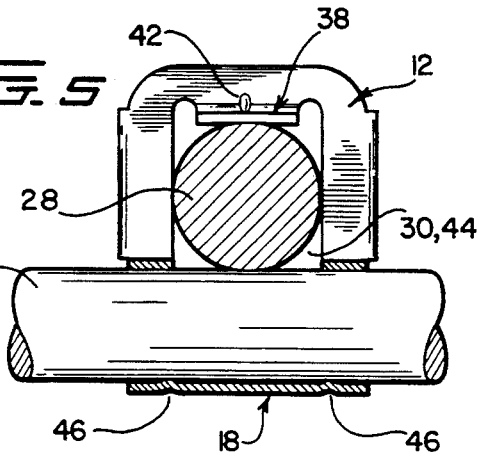
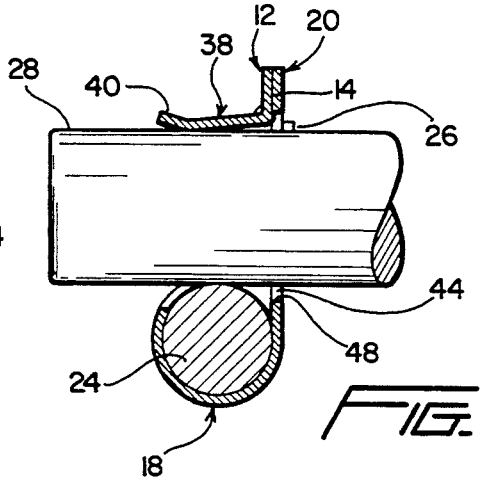
FIG. 6

LOCATOR CLIP

BACKGROUND OF THE INVENTION

The invention is broadly concerned with the mounting and positioning of heating elements in appliances, particularly tubular sheathed electric heating elements in dishwashers.

The elements must be precisely positioned, both vertically and horizontally, to prevent the exposure of portions of the appliance assembly to excess heat. This is of special concern when such portions are of synthetic resinous materials.

It is also essential, as a part of the safety control of the appliance, that the element be maintained against a temperature sensing probe to closely monitor the temperature of the heating element sheath. The maintaining of appropriate temperature sensing contact between the temperature probe and the heating element can be a problem as there is a tendency for relative movement between the temperature probe and heating element as the temperature of the heating element varies.

Difficulties are also encountered in providing for a stable support for the heating element in a manner which will not lead to structural damage to the heating element, and will not affect the efficiency and operating capability of the heating element.

SUMMARY OF THE INVENTION

The locator clip of the present invention is intended to comprise the sole means, between the mounted contact ends of the heating element, for locating and stabling positioning the heating element. In conjunction therewith, the locator clip is to retain the heating element both vertically and horizontally.

Another and equally important function of the locator clip is as a means for maintaining constant intimate contact between the heating element sheath and the temperature probe to ensure the desired close monitoring of the temperature of the element sheath as a part of the safety control of the appliance.

The locator clip is preferably formed from a single elongate sheet or strip of relatively thin stainless steel configured to engage about the heating element sheath and in turn receive the temperature probe therethrough to lie transversely across the sheath and in intimate contact therewith.

The clip is configured to receive the heating element sheath laterally within a central portion arcuately or otherwise configured to form a sleeve-like portion to conform to the sheath. A pair of end panels integrally project from the central portion laterally of each other and, through the inherent flexible resiliency of the sheet, particularly the central portion thereof, are manipulated to overlie each other in face to face relation after introduction of the heating element sheath in the central portion. Edge clips or ears on one of the end panels fold over and engage the other end panel to retain the clip in its folded or closed position.

The end panels include apertures transversely therethrough which align in the closed position and receive the temperature probe therethrough. The apertures are of a size to expose the heating element sheath for direct intimate engagement of the temperature probe with the sheath. Intimate engagement is assured by an integral spring flap on one of said end panels overlying and downwardly inclined relative to the aligned apertures for engagement and a constant downward biasing of the introduced temperature probe toward the underlying heating element sheath.

The central portion of the clip in the open position of the clip before mounting can be considered a split sleeve with a laterally directed mouth into which the sheath is freely laterally introduced. In the closed position, the sleeve fully encircles and retains the sheath. Small dimples can be formed in the closed sleeve which in turn slightly inwardly deform the sheath. This slight inward deformation has no effect either structurally or functionally on the heating element, and is provided to prevent total freedom of movement of the clip on the element sheath. As a practical matter, the clip will have limited freedom to rotate slightly around the sheath to facilitate introduction of the temperature probe into the aligned clip openings.

The locator clip of the invention is unique in that only a single clip is required for the mounting of the heating element with the clip stabilizing the heating element both horizontally and vertically, and, through a direct engagement with the temperature probe, additionally and significantly functioning as a means for effectively maintaining intimate engagement between the temperature probe and the element sheath.

The clip itself is an economically practical item both from a manufacturing standpoint and from an installation standpoint.

Other details, features and advantages of the invention will become apparent from the more specific disclosure of the invention following hereinafter.

BRIEF DESCRIPTION OF THE DRAWINGS

FIG. 1 is a perspective view of the locator clip from one side thereof;

FIG. 2 is a rotated perspective view of the locator clip;

FIG. 3 is a perspective view of the locator clip folded to engage a heating element;

FIG. 4 is a perspective illustration of the heating element, with portions broken away, mounted in operative position utilizing the locator clip;

FIG. 5 is an enlarged cross-sectional view taken substantially on a plane passing along line 5—5 in FIG. 4; and FIG. 6 is an enlarged cross-sectional view taken substantially on a plane passing along line 6—6 in FIG. 4.

DESCRIPTION OF THE PREFERRED EMBODIMENT

The locator clip 10 is formed from a single sheet or strip of foldable sheet material which is shape-sustaining and has a degree of flexibility or flexible resiliency. A preferred material is thin stainless steel.

The locator clip 10, noting FIGS. 1 and 2 and assuming the orientation of the clip as illustrated therein, includes an upper upperwardly extending first planar end panel 12 having inner and outer faces 14 and 16. A central portion 18, forming a generally semicircular arc extending outwardly beyond the outer face 16 of the upper panel 12, terminates in a lower second planar end panel 20 which projects beyond the inner face 14 of the first upper panel 12 at approximately 75 degrees to the plane of this first panel. The central portion 18 is elongate transversely across the clip 10 and defines what might be considered a split sleeve or a sleeve with a mouth opening laterally toward the inner side of the clip for the reception of a tubular heating element 22, or more particularly the sheath 24 thereof.

The first or upper end panel 12, along the opposed side edges thereof, include integral inwardly extending bendable retaining ears 26. In addition, and in order to accommodate a projecting temperature probe 28 therethrough, the first upper end panel 12 has a central opening 30 defined therethrough. This opening 30 commencing in downwardly spaced relation to the upper edge 32 of the end panel 12, extends for the full height of the panel 12 and partially along the upper leg or extent 34 of the central portion 18 to and slightly into the arcing bight section 36.

A biasing flap 38 is integrally formed with the first end panel 12 centrally along the upper edge of the opening 30 and extends outwardly from the outer face 16 and at a slight downward inclination, for example approximately 69 degrees to the plane of the panel 12 so as to partially restrict the full height of the opening 30 for reasons to be described subsequently. The flap 38 terminates in a slightly upturned outer lip 40 and is, because of the nature of the material of the sheet or strip, inherently flexibly resilient. As desired, a rigidifying gusset 42 can be defined centrally along the joinder between the flap 38 and end panel 12.

The lower end panel 20 also has an opening 44 defined centrally therethrough. This opening 44 is of equal width with the opening 30.

Noting FIG. 3, it will be appreciated that the locator clip 10 is mounted to the heating element sheath 24 by engaging the sheath within the split sleeve or central portion 18 through the laterally opening mouth thereof, after which the lower or second end panel 20 is upwardly bent to lie against the inner face of the upper first end panel 12 to which it is clamped by an inward bending of the opposed ears 26. The element sheath 24 is thus snugly received and frictionally retained in the now completely encircling or closed sleeve 18. Further stabilization of the sheath 24 within the closed sleeve 18 is provided by inwardly dimpling the closed sleeve 18, as at 46 in FIG. 5, to form corresponding slight inward deformations in the sheath. Such dimples, while allowing a limited relative rotation movement of the clip and sheath to facilitate mounting within the appliance, substantially fix the locator clip to the sheath.

When mounted to the sheath, the end panel opening 44 aligns with the end panel opening 30 on an axis transverse of the sleeve, with corresponding upper and side edges of the openings laterally aligning with each other. However, the lower edge 48 of the second end panel opening 44 is positioned slightly below the lower edge of the first end panel 12 where this end panel 12 integrally joins the upper leg 34 of the central portion or sleeve 18. As such, and as shall be explained in more detail subsequently, the lower edge 48 of the opening 44 does not interfere with the free and intimate engagement of the temperature probe 28 with the sleeve-retained heating element sheath 24.

After a mounting of the locator clip to the element sheath 24, the locator clip with attached heating element mounts to the temperature probe 28. This is effected in a manner whereby the heating element is precisely positioned both vertically and horizontally, and retained in intimate engagement with the temperature probe. More specifically, the locator clip is positioned to align the temperature probe with the overlying openings 30 and 44, after which the locator clip is pressed onto the temperature probe 28. The width of the openings 30/44 is such as to allow passage of the temperature probe 28 therethrough while precluding lateral shifting of the probe between the side edges of the openings. Similarly, the height of the openings 30/44 is so restricted by the downwardly inclined retaining flap 38 as to require a positive upward flexing of this flap 38 as the probe is introduced through the openings. The biasing force of the flap in turn effects a positive and constant downward force on the temperature probe and a relative upward movement of the heater element sheath into engagement with the temperature probe through that portion of the opening 30 which extends along the upper leg 34 of the sleeve 18. In other words, the extension of the opening 30 fully exposes a transverse portion of the element sheath which is in turn engaged directly and intimately by the temperature probe 28. The probe is in turn retained in intimate engagement, not withstanding such expansion and contraction as may be encountered during use of the heater element, by the constant biasing force of the overlying flap 38. This intimate engagement will be best noted in FIGS. 5 and 6, and is particularly significant in providing for a close monitoring of the temperature of the element sheath as a part of the safety control of the appliance.

With reference to FIG. 4, an installation within a dishwasher or the like is illustrated wherein the heating element 22 has the free contact ends 50 thereof downturned, extended through and engaged to a base wall 52 in any conventional manner, as by retaining collars 54 and nuts. Preferably the only other mount for the heating element 22 is the locator clip 10 which is centrally mounted on the heating element sheath 24 and, in the manner previously described, engaged with a projecting temperature probe 28 affixed to and extending through the side or back wall 56 of the appliance tub or internal chamber. An inherent degree of flexibility within the heating element 22 allows for an initial mounting of either the contact ends 50 or the sheath mounted locator clip 10, or in fact a simultaneous engagement and seating of both in the operative position within the dishwasher or the like appliance.

The foregoing is illustrative of the features of the invention, and should not be considered as limitations on the scope of the invention as other embodiments incorporating such features may occur to those skilled in the art.

I claim:

1. In an electrically heated appliance, spaced first and second wall portions, a heating element having a tubular sheath with opposed contact ends, means mounting said contact ends to said first wall portion, a temperature probe extending from said second wall portion, and a locator clip mounting said heating element sheath, intermediate said contacts, to said temperature probe, said clip comprising first means for receiving and retaining the heating element sheath, second means adjacent said first means for slidably receiving the temperature probe therein and supporting said clip on said probe with said sheath in contact with said probe, and means for resiliently biasing said probe and said sheath relatively toward engagement with each other.

2. The appliance of claim 1 wherein said first means for receiving and retaining the heating element sheath comprises an elongate sleeve having a portion of said heating element sheath received longitudinally therethrough, said second means for receiving said temperature probe comprising at least one panel integral with said sleeve along the length thereof, said panel projecting laterally beyond said sleeve, and an opening defined through said panel and opening transversely across said sleeve, said probe being slidably received through said opening, said opening including a continuing portion thereof extending transversely across said sleeve and exposing the portion of the sheath received in said sleeve, said probe engaging against said sheath portion, said means for biasing comprising a resilient member on said panel remote from said sleeve and extending partially across said opening toward said sleeve and engaging against said probe with a resilient biasing force directed toward said sleeve.

3. The appliance of claim 2 herein said resilient member comprises a flap integrally defined from said panel and terminating in a free edge engaging said temperature probe inserted through said opening, said flap having an inherent degree of flexible resiliency and cooperating with said opening to define a restricted passage therethrough whereby a deflection of said flap is required for passage of said temperature Probe through said opening.

* * * * *